United States Patent [19]

Maes et al.

[11] 4,162,915

[45] Jul. 31, 1979

[54] PROCESS FOR TREATING LEAD-COPPER-SULPHUR CHARGES

[75] Inventors: Robert H. Maes, Hove; Luc M. Fontainas, Antwerp, both of Belgium

[73] Assignee: Metallurgie Hoboken-Overpelt, Brussels, Belgium

[21] Appl. No.: 829,780

[22] Filed: Sep. 1, 1977

[30] Foreign Application Priority Data

Sep. 6, 1976 [BE] Belgium ..... 732

[51] Int. Cl.[2] ..... C22D 7/06

[52] U.S. Cl. ..... 75/14; 75/63; 75/70; 75/72; 75/77; 75/83; 75/85; 75/86

[58] Field of Search ..... 75/14, 63, 72, 77, 83, 75/86, 85, 70

[56] References Cited

U.S. PATENT DOCUMENTS

| | | | |
|---|---|---|---|
| 1,285,714 | 11/1918 | Hulst | 75/77 |
| 1,333,720 | 3/1920 | Johnson | 75/72 |
| 1,386,503 | 8/1921 | Hulst et al. | 75/77 |
| 1,803,771 | 5/1931 | Rutherford | 75/63 |
| 2,381,970 | 8/1945 | Collins | 75/63 |
| 3,300,301 | 1/1967 | Malmstrom | 75/77 |
| 3,317,311 | 5/1967 | Davey | 75/72 |
| 3,326,671 | 6/1967 | Worner | 75/72 X |
| 3,666,441 | 5/1972 | Milner | 75/63 |

FOREIGN PATENT DOCUMENTS

| | | |
|---|---|---|
| 506406 | 2/1953 | Belgium . |
| 169990 | 11/1922 | United Kingdom . |
| 324902 | 2/1930 | United Kingdom . |
| 695158 | 8/1953 | United Kingdom . |
| 925822 | 5/1963 | United Kingdom . |

*Primary Examiner*—M. J. Andrews

*Attorney, Agent, or Firm*—Pennie & Edmonds

[57] ABSTRACT

Lead-copper-sulphur charges (e.g., ores and concentrates) containing at least one of the elements Fe, Ag, Bi, Zn and Sn are treated pyrometallurgically to recover their metal values by a process comprising the steps of (a) smelting the charge to produce a slag phase containing at least about 10% Pb, a copper matte phase containing less than about 65% Cu, and a lead bullion phase; (b) separating the slag, matte and bullion phases formed in step (a); (c) reducing the molten slag separated in step (b) to decrease the lead content thereof to less than about 2% and form thereby a lead bullion phase; and (d) separating the slag and bullion phases formed in step (c). According to the process of the invention, the copper matte phase formed in step (a) is substantially free of iron; most of the silver is collected in step (a) in the copper matte and lead bullion phases; most of the bismuth is collected in the bullion phase of step (a); most of the iron, zinc, and tin are collected in the slag phase formed in step (a); the lead bullion phase formed in step (c) is substantially free of silver and bismuth; the slag phase formed in step (c) is substantially free of zinc and tin, and most of the zinc is contained in fly ashes.

13 Claims, 3 Drawing Figures

PROCESS FOR TREATING LEAD-COPPER-SULPHUR CHARGES

BACKGROUND OF THE INVENTION

This invention relates to a pyrometallurgical process for treating lead-copper-sulphur charges constituted from raw materials such as ores and concentrates, and/or from by-products such as calcines, leaching residues, fly ashes, ashes, slags, mattes, drosses and slimes, and/or from secondary metals. Such charges usually contain, besides substantial amounts of Pb, Cu and S, many desirable non-ferrous metals in minor amounts such as Ag, Bi, Ni, Co, As, Sb, Zn and Sn as well as Fe.

Heretofore such charges were usually treated by sinter-roasting followed by reduction smelting.

Sinter-roasting of sulphurized fines is generally carried out in an endless belt apparatus of the Dwight-Lloyd type. Drawbacks inherent to that process are well-known to those skilled in the art, such as the need for recycling a substantial amount of crushed sinter in order to give sufficient porosity to the sinter-bed and to avoid excessive heating thereof, the need for limiting the lead content of the bed, e.g., by addition of crushed slag, in order to avoid weakening of the bed, as well as the need for maintaining the initial sulphur content of the sinter-bed above a given value in order to avoid production of gases which are too poor in sulphur dioxide.

Reduction smelting is usually carried out in a shaft furnace. The charge consists of sinter, coke and fluxes and may also contain lumpy material and pelletized or otherwise compacted fines. The charge must contain enough sulphur to produce a copper-collecting matte phase. At least two other phases are also produced: a slag phase and a lead bullion phase. Reduction is controlled so as to extract as much of the non-ferrous metals into the matte and bullion phases as possible with minimum reduction of iron.

However, it is not possible to decrease the lead content of the slag phase below about 2% (all percentages herein are by weight) without enriching the copper-collecting matte phase with such amounts of iron that further converting treatment of the latter becomes less economical, as a result of which losses of less reducible metals such as Sn, Co and Zn are high. If the charge contains small amounts of elements such as As, Sb, Sn and Ni, which is usually the case, a fourth phase may be produced composed of an arsenical alloy which is difficult to separate from the lead bullion phase, if the matte phase contains more than about 40% Cu. Therefore, the copper content of the matte has to be limited to about 40%, so that its further converting treatment becomes less economical. Moreover, the lead content of the charge must be limited, e.g., by recycling slag, in order to avoid loss of mechanical resistance of the charge. Finally, the accumulation of numerous impurities within the lead bullion phase complicates its further refining treatment.

In view of the foregoing limitations and disadvantages of prior known treatment methods, there is need for an improved process for the pyrometallurgical treatment of lead-copper-sulphur charges.

Accordingly, it is an object of the present invention to provide a process for the pyrometallurgical treatment of lead-copper-sulphur charges, which allows collecting the lead in two different bullion phases, each of which collects selectively and separately a portion of the impurities in the charge, producing a matte whose copper content is not limited to 40%, and obtaining high extraction rates even for the less reducible non-ferrous metals present in the charge.

Another object is to provide a process for the pyrometallurgical treatment of lead-copper-sulphur charges which avoids sinter-roasting and which accepts such charges regardless of their lead contents.

These and other objects of the present invention as well as a fuller understanding thereof can be had by reference to the following description, drawings and claims.

SUMMARY OF THE INVENTION

The foregoing objects are achieved according to the present invention by a process for treating a Pb-Cu-S charge containing at least one of the elements Fe, Ag, Bi, Zn and Sn, which process comprises the steps of:

(a) smelting the charge while maintaining conditions under which smelting produces (i) a slag phase containing at least about 10% Pb, (ii) a copper mate phase containing less than about 65% Cu and (iii) a lead bullion phase;

(b) separating from each other the slag, copper matte and lead bullion phases produced in step (a);

(c) reducing the slag phase separated in step (b), in the molten state, while maintaining conditions under which reduction decreases the lead content of the slag phase to a value lower than about 2%, thereby producing a lead bullion phase; and (d) separating from each other the slag and lead bullion phases produced in step (c), thereby obtaining in step (a) a copper matte phase which is almost free of Fe, collecting in step (a) most of the Ag in the copper matte and lead bullion phases, most of the Bi in the bullion phase and most of the Fe, Zn and Sn in the slag phase, and obtaining in step (c) a lead bullion which is almost free from Ag and Bi, a slag which is almost free from Zn and Sn, and fly ashes containing most of the Zn.

If the initial Pb-Cu-S charge contains more arsenic than that required for saturating the slag formed in step (a), an arsenical alloy phase is produced in step (a) which collects most of the nickel, if the latter is present in the charge, and which is at least partially dissolved in the lead bullion of step (a). The dissolved arsenical alloy can be easily separated from that lead bullion by cooling the latter.

The arsenic in the slag of step (a) forms an arsenical alloy phase in step (c) which collects most of the cobalt, if the latter is present in the charge, and which is at least partially dissolved in the lead bullion of step (c). The dissolved arsenical alloy can be easily separated from that lead bullion by cooling the latter.

In carrying out the process of the present invention, it is critical to produce in step (a) a slag containing at least about 10% Pb, a copper matte phase containing less than about 65% Cu, and a lead bullion phase; and in step (c), a slag containing less than about 2% Pb. Should the slag of step (a) contain less than about 10% Pb, the lead bullion phase of step (a) would collect Sn and As to a considerable extent and the copper matte phase would contain excessive amounts of iron and zinc. Should the matte contain about 65% or more Cu, copper would be slagged to a considerable extent and the arsenical alloy which may be formed in step (a) would be very hard to separate from the lead bullion phase of step (a). Should the slag produced in step (c) contain about 2% or more Pb, then Zn, Sn and Co would remain slagged to a considerable extent.

In the case where the Pb-Cu-S charge contains nickel and/or cobalt, it is also critical to incorporate enough arsenic in the charge so as to have those elements collected in arsenical alloy phases. Such arsenic may be added in any convenient form, e.g., as arseniferous concentrates or as arseniferous by-products such as fly ashes and speisses.

The lead content of the slag formed in step (a) is preferably between about 20% and about 40% in order to obtain a highly selective slagging of Fe, Zn, Sn and Co as well as a slag with low melting point and low corrosiveness. Below about 20% Pb slagging selectivity and slag fusibility decrease, whereas above about 40% Pb the slag becomes fairly corrosive.

The copper content of the matte phase of step (a) is preferably between about 50% and about 60% so as to make its further converting treatment more economical. However, if a nickeliferous charge is treated and a nickel-rich arsenical alloy is desired to be produced, the copper content of the matte should be between about 40% and about 50%.

The lead content of the slag reduced in step (c) is preferably between about 0.15% and about 1% in order to optimize the recovery of Pb, Sn, Zn and Co without reducing excessive amounts of iron.

If the slag of step (a) contains lead silicate, which depends, of course, on the silica content of the charge, it has been found particularly advantageous to add CaO in step (c) in an amount sufficient to displace lead from its silicate.

If a cobalt-poor arsenical alloy phase is produced in step (c), which depends, of course, on the cobalt content of the charge, then such phases is advantageously recycled to step (a) in order to subsequently obtain a more concentrated alloy phase in step (c).

Step (b) is preferably carried out while the products of step (a) are still molten and the slag from step (b) is then advantageously fed, while still molten, to step (c).

Smelting conditions to be maintained in step (a) depend, of course on the composition of the charge and on the smelting results desired to be achieved. Thus, on the one hand, if a 10% Pb slag is sought to be produced, the initial Pb-Cu-S charge will require a more reducing (or less oxidizing) smelting treatment than in the case where it is desired to produce a 30% Pb slag. On the other hand, if a 10% Pb slag is desired, a charge containing mainly oxidized or sulphatized constituents will require more reducing (or less oxidizing) smelting than a charge having mainly sulphurized or metallic constitutents. The determination of appropriate smelting conditions to secure the foregoing results will be apparent to those skilled in the art. The same is true for the conditions to be maintained in step (c) which depend, of course, on the composition of the slag of step (a) and on the reducing results desired. Those skilled in the art will appreciate that the copper content of the copper matte phase of step (a) can be controlled by adjusting the Cu:S ratio of the Pb-Cu-S charge, said copper content increasing with said ratio.

Suitable methods for controlling the smelting conditions in step (a) include adding the following materials to the Pb-Cu-S charge: carbonaceous materials such as coke and/or oxygen-containing materials such as calcines, sulphates and drosses and/or sulphurous material such as elemental sulphur, mattes and sulphide concentrates and/or metallic materials such as scraps, as well as blowing oxidizing or reducing gases into the melt.

In step (c), a strong reducing agent such as coke should be used.

Steps (a) and (c) can be carried out in any furnace which affords the temperatures required for the complete melting of the charge. Step (a) can be carried out, for instance, in a shaft furnace of the water-jacket type. However, such furnace has the disadvantage that smelting of the charge is normally obtained by combustion of coke mixed with the charge, which coke is so reducing that production of lead-rich slags becomes quite difficult. Moreover, such a furnace requires a sinter-roasted charge. Step (a) can also be carried out in a reverberatory furnace. This furnace presents, however, the disadvantage of producing large amounts of fly ashes and combustion gases, whereby sulphur dioxide resulting from the smelting reactions becomes highly diluted. For this reason, a short rotary-type furnace ("Kurztrommelofen") as well as the top-blown rotary converter and the bottom-blown tilting converter are better suited. Converter smelting is, however, limited to sulphide-rich concentrates.

Some charges or portions thereof can also be smelted by suspension smelting or any other direct smelting process, in which the materials to be smelted are injected in a combustion room together with an oxygen-containing gas and, if desired, with make-up fuel. However, such processes can be applied neither to lumpy materials nor to charges with low sulphide content.

The above disadvantages and limitations can be avoided if step (a) is carried out in an electric submerged-arc furnace. This type of furnace is suited for any kind of feed, whether or not sinter-roasted, and regardless of lead content. Moreover, it produces only small amounts of gases, which makes dust collection and recovery of sulphur dioxide as sulfuric acid easier.

Step (c) can also be carried out in a shaft furnace. A hot top furnace would, however, be necessary in order to obtain an acceptable recovery rate for zinc which would otherwise condense to a large extent upon the incoming feed and be lost in the slag. Moreover, since a shaft furnace cannot be fed with liquid material, it would also be necessary to solidify and crush the slag from step (a).

Carrying out step (c) in a reverbatory furnace, in a short rotary furnace or in a converter would involve, as in the case of step (a), the production of large amounts of gases and fly ashes, although some improvements can be realized by techniques such as submerged combustion and/or oxygen enrichment.

An electric submerged arc furnace also avoids the above limitations and disadvantages. Therefore, step (c) is preferably conducted in an electric submerged arc furnace, wherein zinc volatilizes readily and gas production is low and which may be fed directly with the molten slag from step (a).

DESCRIPTION OF THE PREFERRED EMBODIMENTS

Figure 1:
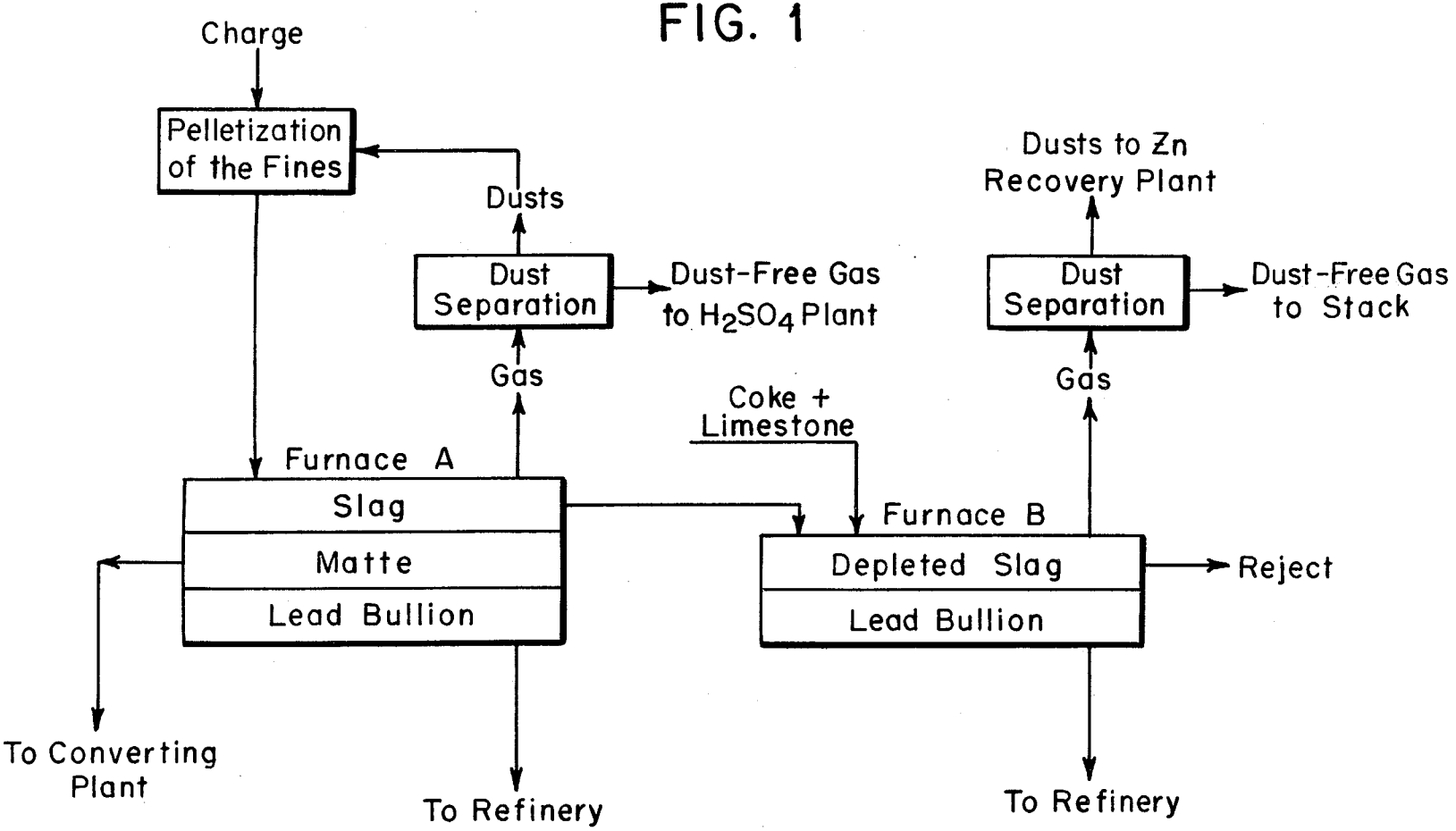

The following examples, in conjunction with the accompanying drawings, are intended to illustrate, without limitation, the process of the present invention and the advantages thereof.

EXAMPLE 1

In this example, which illustrates the production of a copper-rich matte and an arsenical alloy which is relatively low in nickel, a 190 kg charge is treated, which is composed of a Pb-Cu-S concentrate (8%), Pb-Cu ashes (27%), Cu- and Pb-containing slags (13%), Cu-Fe-Pb containing mattes (12%), residues from the leaching of blendes (14%), fly ashes (13%), metallic scraps (2%), dross (9%) and slimes (2%). The charge has the following composition: 1197 ppm Ag, 35.58% Pb, 11.50% Cu, 0.06% Bi, 0.64% Ni, 0.59% Co, 1.50% As, 0.71% Sb, 0.36% Sn. 7.13% Zn, 1.58% CaO, 6.09% $SiO_2$, 5.65% Fe and 8.33% S.

After addition of 8 kg of sand containing 95% $SiO_2$, the above charge is smelted at 1200° C. in a 30 kW electric submerged arc furnace. Fly ashes are collected and, when smelting is completed, the furnace is emptied and the various phases are separated from complete solidification of the smelt. Such separation of the solidified components of the smelt is made feasible by the fact that the solidified smelt has a layered structure and the various layers can be separated by hammering; very often, a slight blow upon the solidified smelt is sufficient to separate the various layers. The smelting results are tabulated in Table IA, below.

A quantity of slag (95 kg) from the foregoing smelting step is smelted with 16 kg of limestone and 2.8 kg of coke at 1200° C. in the same furnace. Fly ashes are collected and smelting phases separated after emptying of the furnace and complete solidification of the smelt. The smelting results are tabulated in table IB, below.

EXAMPLE 2

In this run, which illustrates the production of a matte which is relatively low in copper and a nickel-rich arsenical alloy, a 2050 kg charge is treated, which is composed of a Pb-Cu-S concentrate (20%), residues from the leaching of blendes (10%), Pb-Cu ashes (25%), copper-rich slags (25%), fly ashes (12%) and metallic scraps (8%). The charge has the following composition: 359 ppm Ag, 38.87% Pb, 9.28% Cu, 0.08% Bi, 1.24% Ni, 0.55% Co, 1.90% As, 0.68% Sb, 0.55% Sn, 3.41% Zn, 3.55% CaO, 7.77% $SiO_2$, 7.55% Fe and 7.03% S.

After addition of 38 kg of elemental sulphur, which is pelletized with the fines of the charge, the charge is smelted batchwise at 1200° C. in a 60 kW electric submerged arc furnace. Fly ashes are collected and, when smelting is completed, the furnace is emptied and the various phases are separated after complete solidification of the smelt. The smelting results are tabulated in Table IIA below.

The slag from the above smelting step is then smelted batchwise with 60 kg of limestone and 28 kg of coke at 1200° C. in the same 60 kW furnace. Fly ashes are collected and smelting phases separated after emptying of the furnace and complete solidification of the smelt. The smelting results are tabulated in Table IIB, below.

Table IA

| | Analysis | | | | | | | | | | | | | |
|---|---|---|---|---|---|---|---|---|---|---|---|---|---|---|
| | Ag ppm | Pb % | Cu % | Bi % | Ni % | Co % | As % | Sb % | Sn % | Zn % | CaO % | SiO2 % | Fe % | S % |
| Fly ashes | 269 | 63.27 | 0.44 | 0.117 | <0.05 | | 4.06 | 0.28 | 0.55 | 4.66 | | | | 7.10 |
| Slag | 27 | 22.27 | 1.54 | 0.002 | 0.19 | 1.09 | 1.14 | 0.54 | 0.56 | 13.23 | 3.05 | 20.27 | 10.82 | 0.18 |
| Matte | 2390 | 24.94 | 54.76 | 0.009 | 0.87 | 0.23 | 0.85 | 0.52 | 0.05 | 0.09 | | | 0.18 | 15.60 |
| Arsenical alloy | 3665 | 25.42 | 36.32 | 0.079 | 10.39 | 0.28 | 12.02 | 7.58 | 0.11 | <0.05 | | 0.09 | 2.00 | |
| Lead bullion | 4400 | 95.82 | 1.12 | 0.34 | 0.12 | | 0.04 | 0.43 | <0.001 | | | | | 0.10 |

| | Material balance | | | | | | | | | | | | | | |
|---|---|---|---|---|---|---|---|---|---|---|---|---|---|---|---|
| | kg | Ag g | Pb kg | Cu kg | Bi g | Ni kg | Co kg | As kg | Sb kg | Sn kg | Zn kg | CaO kg | SiO2 kg | Fe kg | S kg |
| Fly ashes | 15.5 | 4.2 | 9.81 | 0.07 | 18.1 | <0.01 | | 0.63 | 0.04 | 0.09 | 0.72 | | | | 1.10 |
| Slag | 95.8 | 2.6 | 21.33 | 1.47 | 1.9 | 0.18 | 1.04 | 1.09 | 0.52 | 0.54 | 12.67 | 2.92 | 19.42 | 10.36 | 0.17 |
| Matte | 33.6 | 80.3 | 8.38 | 18.40 | 3.0 | 0.29 | 0.08 | 0.29 | 0.17 | 0.02 | 0.03 | | | 0.06 | 5.24 |
| Arsenical alloy | 6.4 | 23.5 | 1.63 | 2.32 | 5.1 | 0.66 | 0.02 | 0.77 | 0.49 | 0.01 | 0.00 | | | 0.01 | 0.13 |
| Lead bullion | 27.6 | 121.4 | 26.45 | 0.31 | 93.8 | 0.03 | | 0.01 | 0.12 | 0.00 | | | | | 0.03 |
| Total | 178.9 | 232.0 | 67.60 | 22.57 | 121.9 | 1.17 | 1.14 | 2.79 | 1.34 | 0.66 | 13.42 | 2.92 | 19.42 | 10.43 | 6.67 |

Table IB

| | Analysis | | | | | | | | | | | | | |
|---|---|---|---|---|---|---|---|---|---|---|---|---|---|---|
| | Ag ppm | Pb % | Cu % | Bi % | Ni % | Co % | As % | Sb % | Sn % | Zn % | CaO % | SiO2 % | Fe % | S % |
| Fly ashes | 5 | 8.,02 | 0.20 | 0.002 | <0.05 | <0.05 | 0.26 | 0.07 | 0.27 | 73.27 | | | <0.05 | 0.12 |
| Slag | <1 | 0.76 | 0.15 | <0.001 | <0.05 | 0.32 | <0.05 | <0.05 | 0.20 | 3.06 | 19.78 | 31.39 | 15.09 | 0.25 |
| Arsenical alloy | 22 | 6.07 | 17.54 | 0.001 | 2.81 | 18.60 | 18.42 | 2.36 | 3.28 | <0.05 | | | 30.37 | 0.25 |
| Lead bullion | 103 | 95.13 | 1.27 | 0.006 | 0.08 | | 0.15 | 1.75 | 1.09 | | | | | <0.01 |

| | Material balance | | | | | | | | | | | | | | |
|---|---|---|---|---|---|---|---|---|---|---|---|---|---|---|---|
| | kg | Ag g | Pb kg | Cu kg | Bi g | Ni kg | Co kg | As kg | Sb kg | Sn kg | Zn kg | CaO kg | SiO2 kg | Fe kg | S kg |
| Fly ashes | 14.3 | 0.1 | 1.15 | 0.03 | 0.3 | <0.01 | <0.01 | 0.04 | 0.01 | 0.04 | 10.48 | | | <0.01 | 0.02 |
| Slag | 59.3 | <0.1 | 0.45 | 0.09 | <0.6 | <0.03 | 0.19 | <0.03 | <0.03 | <0.12 | 1.81 | 11.71 | 18.58 | 8.93 | 0.15 |
| Arsenical alloy | 5.7 | 0.1 | 0.35 | 1.00 | 0.1 | 0.16 | 1.06 | 1.05 | 0.13 | 0.19 | <0.003 | | | 1.734 | 0.01 |
| Lead bullion | 20.7 | 2.1 | 19.69 | 0.26 | 1.2 | 0.02 | | 0.03 | 0.36 | 0.23 | | | | | <0.002 |
| Total | 99.9 | 2.4 | 21.64 | 1.38 | 2.2 | 0.22 | 1.26 | 1.15 | 0.53 | 0.58 | 12.29 | 11.71 | 18.58 | 10.67 | 0.18 |

Table IIA

| | Analysis | | | | | | | | | | | | | |
|---|---|---|---|---|---|---|---|---|---|---|---|---|---|---|
| | Ag | Pb | Cu | Bi | Ni | Co | As | Sb | Sn | Zn | CaO | SiO2 | Fe | S |

Table IIA-continued

| | ppm | % | % | % | % | % | % | % | % | % | % | % | % | % |
|---|---|---|---|---|---|---|---|---|---|---|---|---|---|---|
| Fly ashes | 51 | 52.12 | 0.61 | 0.13 | — | — | 2.27 | 0.18 | 0.50 | 3.07 | — | — | — | 7.52 |
| Slag | 20 | 25.40 | 1.05 | 0.004 | 0.26 | 1.08 | 1.43 | 0.71 | 1.06 | 7.99 | 8.14 | 16.09 | 17.26 | 0.25 |
| Matte | 646 | 34.73 | 44.27 | 0.006 | 0.76 | 0.10 | 0.50 | 0.26 | 0.05 | 0.10 | — | — | 0.10 | 15.50 |
| Arsenical alloy | 951 | 7.69 | 29.541 | 0.05 | 29.73 | 1.07 | 24.69 | 5.38 | 0.10 | — | — | — | — | 1.80 |
| Lead bullion | 1331 | 97.00 | 1.25 | 0.42 | — | — | 0.11 | 0.54 | — | — | — | — | — | 0.10 |

Material balance

| | kg | Ag g | Pb kg | Cu kg | Bi g | Ni kg | Co kg | As kg | Sb kg | Sn kg | Zn kg | CaO kg | SiO2 kg | Fe kg | S kg |
|---|---|---|---|---|---|---|---|---|---|---|---|---|---|---|---|
| Fly ashes | 114 | 5.8 | 59.4 | 0.7 | 148.2 | — | — | 2.6 | 0.2 | 0.6 | 3.5 | — | — | — | 8.6 |
| Slag | 960 | 19.2 | 243.8 | 10.1 | 38.4 | 2.5 | 10.4 | 132.7 | 6.8 | 10.2 | 76.7 | 78.1 | 1564.5 | 165.7 | 2.2 |
| Matte | 311 | 200.9 | 108.0 | 137.6 | 18.7 | 2.4 | 0.3 | 1.6 | 0.8 | 0.2 | 0.3 | — | — | 0.3 | 48.2 |
| Arsenical alloy | 72 | 68.5 | 5.5 | 21.2 | 3.6 | 21.3 | 0.8 | 17.7 | 3.9 | 0.1 | — | — | — | — | 1.3 |
| Lead bullion | 349 | 464.5 | 338.2 | 4.4 | 1465.8 | — | — | 0.4 | 1.9 | — | — | — | — | — | 0.3 |
| Total | 1806 | 758.9 | 754.9 | 174.0 | 1674.7 | 26.2 | 11.5 | 346.0 | 13.6 | 11.1 | 80.5 | 78.1 | 154.5 | 166.0 | 60.6 |

Table IIB

Analysis

| | Ag ppm | Pb % | Cu % | Bi % | Ni % | Co % | As % | Sb % | Sn % | Zn % | CaO % | SiO2 % | Fe % | S % |
|---|---|---|---|---|---|---|---|---|---|---|---|---|---|---|
| Fly ashes | <1 | 16.24 | — | — | — | — | 0.65 | — | 0.28 | 63.76 | — | — | 0.10 | 0.15 |
| Slag | <1 | 0.52 | 0.09 | — | 0.04 | 0.12 | 0.05 | 0.05 | 0.35 | 3.89 | 18.15 | 25.68 | 25.10 | 0.35 |
| Arsenical alloy | 5 | 5.17 | 12.20 | 0.003 | 4.32 | 16.60 | 21.48 | 3.19 | 4.32 | 0.50 | — | — | 28.49 | 0.30 |
| Lead bullion | 74 | 92.46 | 1.25 | 0.015 | — | — | 0.11 | 2.13 | 2.16 | — | — | — | — | 0.01 |

Material balance

| | kg | Ag g | Pb kg | Cu kg | Bi g | Ni kg | Co kg | As kg | Sb kg | Sn kg | Zn kg | CaO kg | SiO2 kg | Fe kg | S kg |
|---|---|---|---|---|---|---|---|---|---|---|---|---|---|---|---|
| Fly ashes | 73 | — | 11.8 | — | — | — | — | 0.5 | — | 0.2 | 46.4 | — | — | 0.1 | 0.1 |
| Slag | 565 | — | 2.9 | 0.5 | — | 0.2 | 0.7 | 0.3 | 0.3 | 2.0 | 21.9 | 102.5 | 145.0 | 141.8 | 2.0 |
| Arsenical alloy | 53 | 0.3 | 2.7 | 6.4 | 1.6 | 2.3 | 8.8 | 11.3 | 1.7 | 2.3 | 0.3 | — | — | 15.1 | 0.2 |
| Lead bullion | 231 | 17.1 | 213.9 | 2.9 | 34.7 | — | — | 0.2 | 4.9 | 5.0 | — | — | — | — | — |
| Total | 922 | 17.4 | 231.3 | 9.8 | 36.3 | 2.5 | 9.5 | 12.3 | 6.9 | 9.5 | 68.6 | 102.5 | 145.0 | 157.0 | 2.3 |

EXAMPLE 3

In this example, which illustrates the production of an arsenical alloy which is very low cobalt (and therefore requires recycling), a 7000 kg charge is treated, which is composed of a Pb-Cu-S concentrate (12%), residues from the leaching of blendes (17%), Pb-Cu ashes (18%), fly ashes (3%), Cu cements (3%), Pb-Cu-Zn sinter (12%), Cu- and Pb-containing slags (23%), Cu-Fe-Pb containing mattes (8%) and metallic scraps (4%). The charge has the following composition: 1762 ppm Ag, 35.74% Pb, 15.24% Cu, 0.08% Bi, 0.40% Ni, 0.03% Co, 1.88% As, 0.60% Sb, 0.88% Sn, 4.56% Zn, 1.62% CaO, 6.74% $SiO_2$, 7.14% Fe and 6.82% S.

After pelletization of the fines of the charge, the charge is smelted at 1200° C. in the furnace of Example 2. The feed is introduced continuously into the furnace, except for interruptions during tapping of the smelting products. The slag is tapped intermittently from an upper tap hole, whereas the other liquid phases (copper matte phase, arsenical alloy and lead bullion) are tapped intermittently from a bottom tap hole and separated after complete solidification. The smelting results are tabulated in Table IIIA, below.

The slag from the above smelting step is then smelted with 380 kg of limestone and 95 kg of coke at 1200° C. in the same furnace. The furnace is again continuously fed, except for interruptions during the intermittent tapping of the smelting products. The slag is tapped from the upper tap hole, whereas the lead bullion and arsenical alloy are tapped from the bottom taphole and separated after complete solidification. The smelting results are tabulated in Table IIIB, below.

Table IIIA

Analysis

| | Ag ppm | Pb % | Cu % | Bi % | Ni % | Co % | As % | Sb % | Sn % | Zn % | CaO % | SiO2 % | Fe % | S % |
|---|---|---|---|---|---|---|---|---|---|---|---|---|---|---|
| Fly ashes | 257 | 53.24 | 0.64 | 0.16 | — | — | 3.20 | 0.16 | 0.53 | 3.46 | — | — | — | 7.82 |
| Slag | 92 | 35.16 | 1.82 | 0.005 | 0.24 | 0.06 | 2.09 | 0.96 | 1.80 | 9.65 | 3.05 | 15.11 | 15.60 | 0.17 |
| Matte | 3240 | 24.51 | 52.49 | 0.008 | 0.50 | — | 0.84 | 0.24 | 0.03 | 0.12 | — | — | 0.10 | 15.78 |
| Arsenical alloy | 4765 | 22.48 | 41.60 | 0.07 | 10.09 | — | 17.98 | 4.86 | 0.08 | — | — | — | — | 1.52 |
| Lead bullion | 6671 | 96.50 | 1.42 | 0.52 | — | — | 0.16 | 0.49 | — | — | — | — | — | 0.08 |

Material balance

| | kg | Ag kg | Pb kg | Cu kg | Bi kg | Ni kg | Co kg | As kg | Sb kg | Sn kg | Zn kg | CaO kg | SiO2 kg | Fe kg | S kg |
|---|---|---|---|---|---|---|---|---|---|---|---|---|---|---|---|
| Fly ashes | 394 | 0.1 | 209.8 | 2.5 | 0.6 | — | — | 12.6 | 0.6 | 2.1 | 13.6 | — | — | — | 30.8 |
| Slag | 3210 | 0.3 | 1128.6 | 58.4 | 0.2 | 7.7 | 1.9 | 67.1 | 30.8 | 57.8 | 309.8 | 97.9 | 485.0 | 500.8 | 5.5 |
| Matte | 1652 | 5.4 | 404.9 | 867.1 | 0.1 | 8.3 | — | 13.9 | 4.0 | 0.5 | 2.0 | — | — | 1.7 | 260.7 |
| Arsenical alloy | 114 | 0.5 | 25.6 | 47.4 | 0.1 | 11.5 | — | 20.5 | 5.5 | 0.1 | — | — | — | — | 1.7 |
| Lead bullion | 723 | 4.8 | 697.7 | 10.3 | 3.7 | — | — | 1.2 | 3.5 | — | — | — | — | — | 0.6 |

Table IIIA-continued

| | | | | | | | | | | | | | | | |
|---|---|---|---|---|---|---|---|---|---|---|---|---|---|---|---|
| Total | 6093 | 11.1 | 2466.6 | 985.7 | 4.7 | 27.5 | 1.9 | 115.3 | 44.4 | 60.5 | 325.4 | 97.9 | 485.0 | 502.5 | 299.3 |

Table IIB

| | Analysis | | | | | | | | | | | | | |
|---|---|---|---|---|---|---|---|---|---|---|---|---|---|---|
| | Ag ppm | Pb % | Cu % | Bi % | Ni % | Co % | As % | Sb % | Sn % | Zn % | CaO % | SiO2 % | Fe % | S % |
| Fly ashes | — | 13.36 | 0.12 | — | — | — | 0.53 | 0.04 | 0.29 | 66.64 | — | — | 0.08 | 0.13 |
| Slag | — | 0.37 | 0.09 | — | 0.02 | 0.01 | 0.07 | 0.04 | 0.40 | 3.06 | 19.25 | 30.94 | 20.26 | 0.40 |
| Arsenical alloy | 18 | 6.42 | 12.57 | 0.002 | 2.36 | 0.47 | 20.60 | 2.73 | 5.35 | 0.38 | — | — | 457.89 | 0.28 |
| Lead bullion | 263 | 92.25 | 1.09 | 0.0123 | — | — | 0.10 | 1.82 | 2.67 | — | — | — | — | 0.01 |

| | Material balance | | | | | | | | | | | | | | |
|---|---|---|---|---|---|---|---|---|---|---|---|---|---|---|---|
| | kg | Ag kg | Pb kg | Cu kg | Bi kg | Ni kg | Co kg | As kg | Sb kg | Sn kg | Zn kg | CaO kg | SiO2 kg | Fe kg | S kg |
| Fly ashes | 365 | — | 48.8 | 0.4 | — | — | — | 2.0 | 0.1 | 1.0 | 243.5 | — | — | 0.3 | 0.5 |
| Slag | 1520 | — | 5.6 | 1.4 | — | 0.4 | 0.2 | 1.1 | 0.7 | 6.1 | 46.6 | 292.7 | 470.4 | 308.0 | 6.0 |
| Arsenical alloy | 311 | — | 20.0 | 39.1 | — | 7.4 | 1.5 | 64.2 | 8.5 | 16.7 | 1.2 | — | — | 149.2 | 0.9 |
| Lead bullion | 1084 | 0.3 | 1000.5 | 11.8 | 0.1 | — | — | 1.1 | 19.7 | 29.0 | — | — | — | — | 0.1 |
| Total | 3280 | 0.3 | 1074.9 | 52.7 | 0.1 | 7.8 | 1.7 | 68.4 | 29.0 | 52.8 | 291.3 | 292.7 | 470.4 | 457.5 | 7.5 |

EXAMPLE 4

In this run, in which no arsenical alloys are formed, a 5000 kg charge is treated, which is composed of a Pb-Cu-Zn-S concentrate (18%), residues from the leaching of blendes (30%), Pb-Cu-Zn sinter (23%), Pb-containing slags (8%), Pb-Cu and Cu-Zn ashes (16%) and metallic scraps (5%). The charge has the following composition: 765 ppm Ag, 31.32% Pb, 13.11% Cu, 0.10% Bi, 0.03% Ni, 0.11% As, 0.28% Sb, 0.14% Sn, 7.29% Zn, 0.35% CaO, 11.51% $SiO_2$, 9.98% Fe and 7.72% S.

After pelletization of the fines of the charge and addition of 350 kg of limestone, the charge is smelted at 1200° C. in the furnace of Example 2. The feed is continuous except for interruptions during tapping of the smelting products. The slag is tapped intermittently from the upper tap hole; the other liquid phases (matte and lead buillion) are tapped intermittently from the bottom tap hole and separated after complete solidification. The smelting results are tabulated in Table IVA, below.

The slag from the above smelting is then smelted with 300 kg of limestone and 100 kg of coke at 1200° C. in the same furnace. The furnace is again continuously fed, except for interruptions during the intermittent tapping of the smelting products. The slag is tapped from the upper tap hole, whereas the lead bullion is tapped from the bottom tap hole. The smelting results are tabulated in Table IVB, below.

Table IVA

| | Analysis | | | | | | | | | | | | | |
|---|---|---|---|---|---|---|---|---|---|---|---|---|---|---|
| | Ag ppm | Pb % | Cu % | Bi % | Ni % | As % | Sb % | Sn % | Zn % | CaO % | SiO2 % | Fe % | S % | |
| Fly ashes | 209 | 50.86 | 0.48 | 0.51 | — | 0.24 | 0.07 | 0.14 | 2.88 | — | — | — | 7.42 | |
| Slag | 79 | 29.33 | 1.55 | 0.014 | 0.02 | 0.11 | 0.35 | 0.18 | 10.51 | 5.77 | 16.72 | 13.89 | 0.27 | |
| Matte | 2627 | 20.76 | 58.24 | 0.025 | 0.06 | 0.08 | 0.10 | 0.03 | 0.15 | — | — | 0.18 | 16.25 | j |
| Lead bullion | 5409 | 96.00 | 1.63 | 1.42 | — | 0.02 | 0.21 | — | — | — | — | — | 0.12 | |

| | Material balance | | | | | | | | | | | | | | |
|---|---|---|---|---|---|---|---|---|---|---|---|---|---|---|---|
| | kg | Ag kg | Pb kg | Cu kg | Bi kg | Ni kg | As kg | Sb kg | Sn kg | Zn kg | CaO kg | SiO2 kg | Fe kg | S kg | |
| Fly ashes | 270 | 0.1 | 137.3 | 1.3 | 1.4 | — | 0.6 | 0.2 | 0.4 | 7.8 | — | — | — | 20.0 | |
| Slag | 3330 | 0.3 | 976.7 | 51.6 | 0.5 | 0.7 | 3.7 | 11.7 | 6.0350.0 | 192.1 | 556.8 | 462.5 | 9.0 | | |
| Matte | 959 | 2.5 | 199.1 | 558.6 | 0.2 | 0.6 | 0.8 | 1.0 | 0.3 | 1.4 | — | — | 1.7 | 155.8 | |
| Lead bullion | 168 | 0.9 | 161.3 | 2.7 | 2.4 | — | — | 0.4 | — | — | — | — | — | 0.2 | |
| Total | 4727 | 3.8 | 1474.4 | 614.2 | 4.5 | 1.3 | 5.1 | 13.3 | 6.7 | 359.2 | 192.1 | 556.8 | 464.2 | 185.0 | |

Table IVB

| | Analysis | | | | | | | | | | | | | |
|---|---|---|---|---|---|---|---|---|---|---|---|---|---|---|
| | Ag ppm | Pb % | Cu % | Bi % | Ni % | As % | Sb % | Sn % | Zn % | CaO % | SiO2 % | Fe % | S % |
| Fly ashes | — | 13.29 | 0.50 | — | — | 0.47 | 0.03 | 0.05 | 64.78 | — | — | 0.13 | 0.15 |
| Slag | — | 0.82 | 0.71 | — | 0.05 | 0.05 | 0.03 | 0.09 | 4.42 | 17.44 | 26.68 | 23.03 | 0.37 |
| Lead bullion | 271 | 93.20 | 3.40 | 0.037 | — | 0.15 | 1.06 | 0.47 | — | — | — | — | 0.01 |

| | Material balance | | | | | | | | | | | | | | |
|---|---|---|---|---|---|---|---|---|---|---|---|---|---|---|---|
| | kg | Ag kg | Pb kg | Cu kg | Bi kg | Ni kg | As kg | Sb kg | Sn kg | Zn kg | CaO kg | SiO2 kg | Fe kg | S kg |
| Fly ahses | 385 | — | 51.2 | 1.9 | — | — | 1.8 | 0.1 | 0.2 | 249.2 | — | — | 0.5 | 0.6 |

Table IVB-continued

| | | | | | | | | | | | | | | |
|---|---|---|---|---|---|---|---|---|---|---|---|---|---|---|
| Slag | 1945 | — | 15.9 | 13.8 | — | 1.0 | 1.0 | 0.6 | 1.7 | 86.0 | 339.1 | 518.8 | 447.9 | 7.2 |
| Lead bullion | 910 | 0.2 | 848.1 | 31.0 | 0.3 | — | 1.4 | 9.7 | 4.3 | — | — | — | — | 0.1 |
| Total | 3240 | 0.2 | 915.2 | 46.7 | 0.3 | 1.0 | 4.2 | 10.4 | 6.2 | 335.4 | 339.1 | 518.8 | 448.4 | 7.9 |

EXAMPLE 5

On an industrial scale, the charge of Example 4 is treated as illustrated by the flowsheet of FIG. 1.

Referring to FIG. 1, the charge, the fines of which have been pelletized and dried, is continuously fed into furnace A, which is an electric submerged-arc furnace. By smelting the charge in furnace A, three distinct liquid phases are formed, which are separated by gravity: slag, matte and lead bullion. The three phases are tapped separately from the furnace through separate tap holes at different levels. The matte is sent to a converting plant and the lead bullion to a refining plant.

The gases, which are produced in furnace A, are sent, after dust separation, to a sulphuric acid plant. Dusts are incorporated with the fines of the charge.

The slag, which has been tapped from furnace A, is conveyed in the liquid state to furnace B, which is also an electric submerged arc furnace. The slag is therein reduced by addition of coke and limestone. Two distinct liquid phases are thus obtained, which separate by gravity: depleted slag and lead bullion. These two phases are tapped separately from furnace B through separate tap holes at different levels. The depleted slag is rejected and the lead bullion is sent to a refining plant.

The gases, which are produced in furnace B, are discharged as stack gases after dust separation. The dusts are sent to a zinc recovery plant.

EXAMPLE 6

Figure 2:
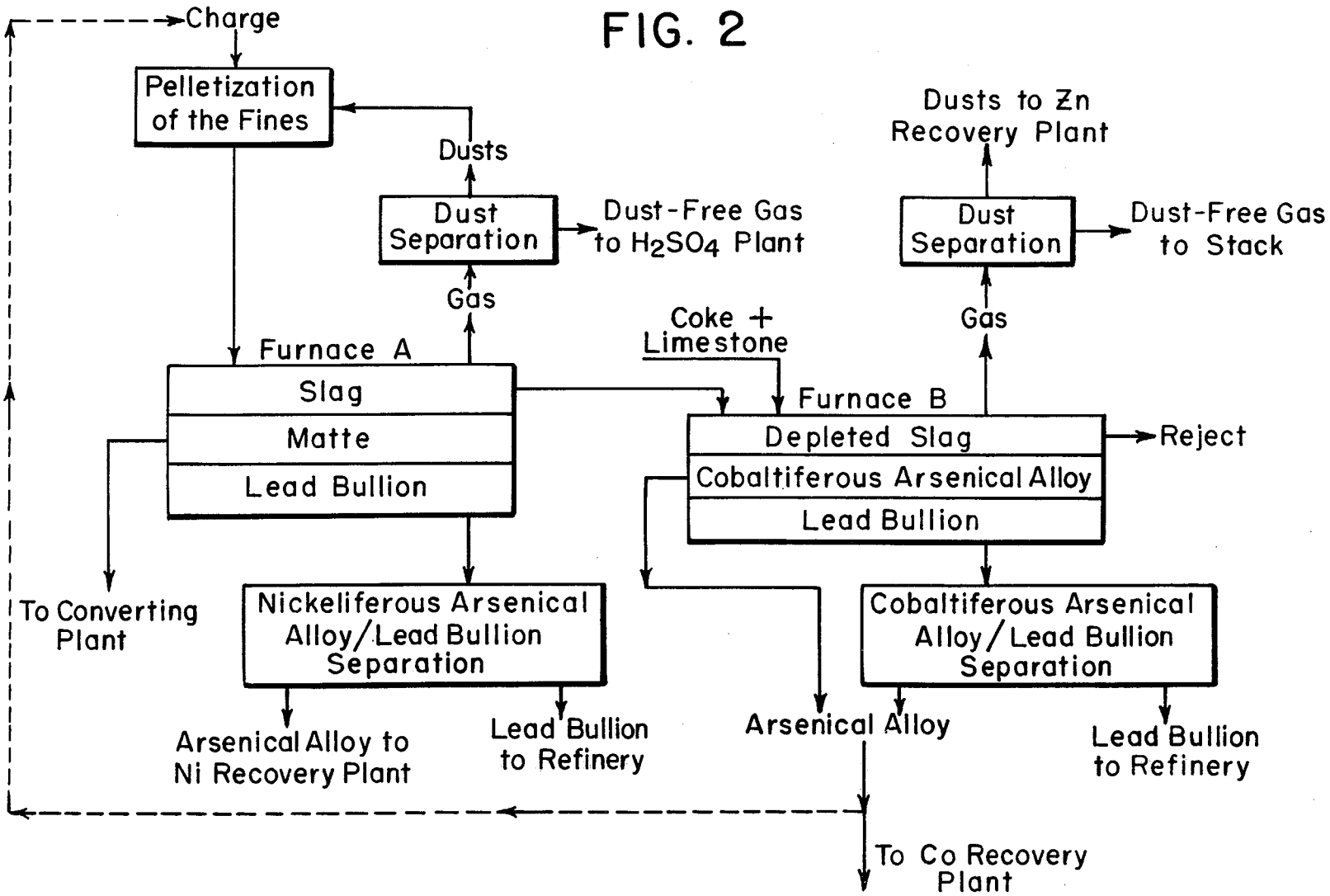

On an industrial scale, the charges of Examples 1 and 3 are treated as illustrated by the flowsheet of FIG. 2.

Referring to FIG. 2, the treatment is the same as in Example 5, except that in furnace A, a nickeliferous arsenical alloy is produced in addition to the slag, matte and lead bullion. Also, in furnace B, a cobaltiferous arsenical alloy is produced in addition to the depleted slag and lead bullion.

At the temperature of about 1200° C., which prevails in furnace A, the nickeliferous arsenical alloy is dissolved in the lead bullion. Hence, that alloy is tapped from furnace A together with the lead bullion. The lead bullion is cooled down to a temperature of about 600° C., at which the nickeliferous arsenical alloy floats and solidifies. The floating alloy is separated from the lead bullion and sent to a nickel recovery plant. The bullion is sent to a refining plant.

At the temperature of about 1200° C., which prevails in furnace B, the cobaltiferous arsenical alloy is only partially dissolved in the lead bullion. The part of cobaltiferous arsenical alloy which is not dissolved in the lead bullion is tapped separately from furnace B whereas the other part, which is dissolved in the lead bullion, is tapped together with the latter. The lead bullion is cooled down to a temperature of about 600° C., at which the cobaltiferous arsenical alloy floats and solidifies. The floating alloy is separated from the lead bullion and sent, together with the alloy which has been tapped separately from furnace B, either to furnace A, if the said alloys are poor in cobalt, which is the case with the charge of Example 3, or to a cobalt recovery plant. The lead bullion is sent to a refining plant.

EXAMPLE 7

Figure 3:
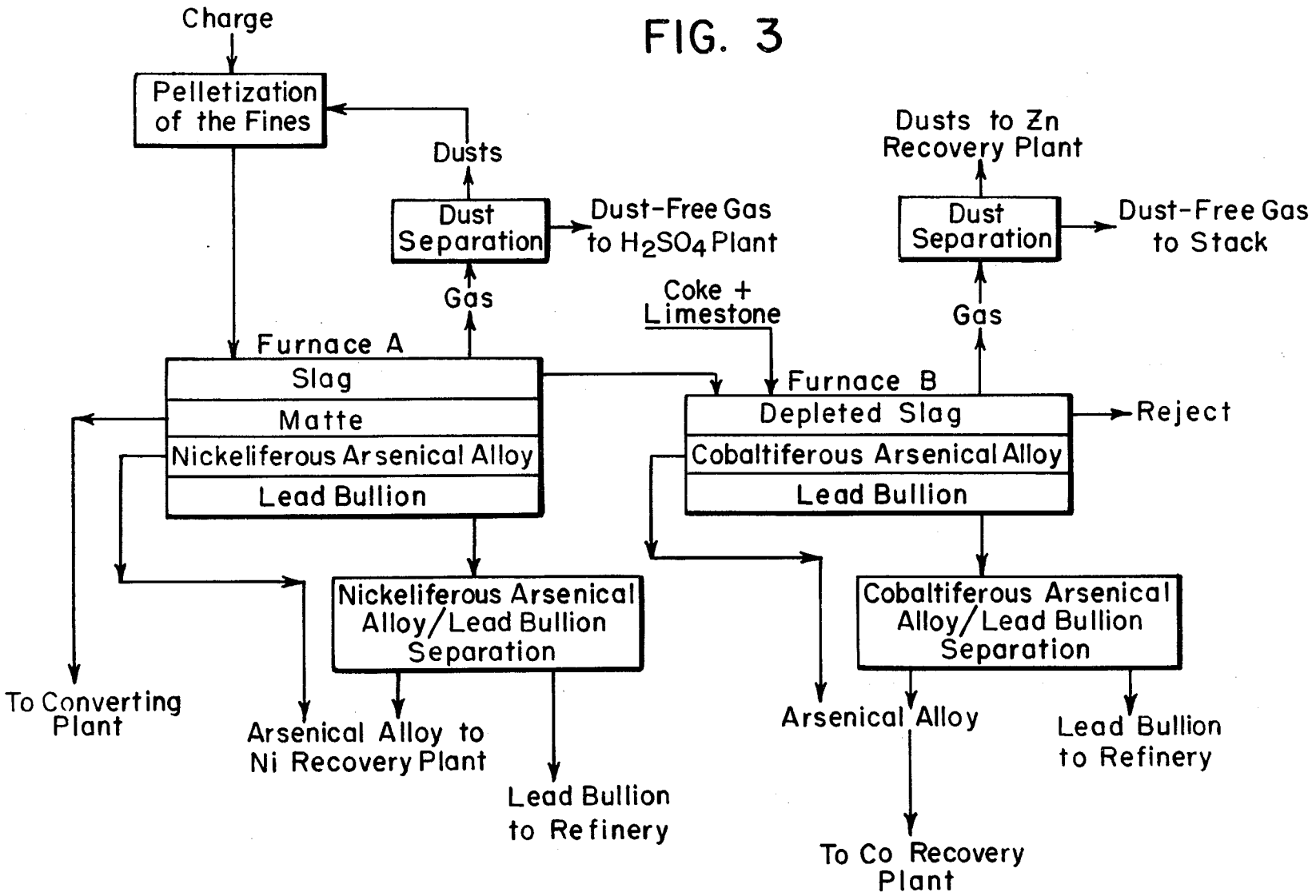

On an industrial scale, the charge of Example 1 is treated as illustrated by the flowsheet of FIG. 3.

Referring to FIG. 3, the treatment is the same as in Example 6, except that the nickeliferous arsenical alloy produced in furnace A is only partially dissolved in the lead bullion. The undissolved part of that alloy is tapped separately from furnace A.

It is understood that changes and variations in the foregoing examples can be made without departing from the scope of the present invention which is defined in the following claims.

We claim:

1. A process for pyrometallurgically treating a Pb-Cu-S charge containing at least one of the elements Fe, Ag, Bi, Zn and Sn, to recover the metal values of said charge, comprising the steps of:

(a) smelting the charge while maintaining chemically reducing, neutral or oxidizing conditions under which said smelting produces (i) a slag phase containing at least about 10% Pb;

(ii) a copper matte phase containing less than about 65% Cu, the amount of said copper content decreasing with decreasing Cu:S ratio in the Pb-Cu-S charge; and (iii) a lead bullion phase, the strength of the reducing conditions employed in said smelting step being greater with increasing degree of oxidation of the Pb-Cu-S charge and greater with decreasing content of Pb in the slag phase produced in said smelting step and the strength of the oxidizing conditions employed in said smelting step being lower with increasing degree of oxidation of the Pb-Cu-S charge and lower with decreasing content of Pb in the slag phase produced in said smelting step;

(b) separating from each other the slag, copper matte and lead bullion phases produced in step (a);

(c) reducing the slag phase separated in step (b), in the molten state, with a strong reducing agent whereby the lead content of the slag phase is lowered to a value less than about 2% thereby producing a lead bullion phase; and (d) separating from each other the slag and lead bullion phases produced in step (c), thereby obtaining in step (a) a matte phase which is substantially free of Fe, collecting in step (a) most of the Ag in the matte and bullion phases, most of the Bi in the bullion phase and most of the Fe, Zn and Sn in the slag phase, and obtaining in step (c) a lead bullion which is almost free from Ag and Bi, a slag which is almost free from Zn and Sn and fly ashes containing most of the Zn.

2. A process according to claim 1 wherein the charge contains Ni, Co and As, the amount of As in the charge being greater than that required for saturating with As the slag produced in step (a), thereby obtaining in step (a), in addition to the aforesaid phases, an arsenical alloy phase, which collects most of the nickel and which is at least partially dissolved in the lead bullion, and in step (c), in addition to the aforesaid phases, an arsenical alloy phase, which collects most of the cobalt and which is at least partially dissolved in the lead bullion.

3. A process according to claim 2 wherein step (b) comprises separating from each other, while still molten, the slag, the matte, and undissolved portion of the nickeliferous arsenical alloy and the lead bullion containing dissolved nickeliferous arsenical alloy, and then cooling the molten lead bullion so as to separate from it the dissolved nickeliferous arsenical alloy contained therein.

4. A process according to claim 2, wherein step (d) comprises separating from each other, while still molten, the slag, the undissolved portion of the cobaltiferous arsenical alloy and the lead bullion containing dissolved cobaltiferous arsenical alloy, and then cooling the molten lead bullion so as to separate from it the dissolved cobaltiferous arsenical alloy contained therein.

5. A process according to claim 4 wherein the cobaltiferous arsenical alloy is recycled to step (a).

6. A process according to claim 1, wherein the lead content of the slag of step (a) is between about 20% and about 40%.

7. A process according to claim 1 wherein the copper content of the matte of step (a) is between about 50% and about 60%.

8. A process according to claim 2 wherein the copper content of the matte of step (a) is between about 40% and about 50%.

9. A process according to claim 1 wherein the lead content of the slag resulting from step (c) is between about 0.15% and about 1%.

10. A process according to claim 1 wherein lead is slagged in step (a) as silicate and CaO is added in step (c) in an amount sufficient to displace lead from the silicate.

11. A process according to claim 1 wherein step (b) is carried out while the products of step (a) are still molten and the slag from step (b) is fed while still molten to step (c).

12. A process according to claim 1 wherein steps (a) and (c) are carried out in an electric submerged-arc furnace.

13. A process according to claim 12 wherein steps (b) and (d) are carried out by tapping the various phases separately from the furnace.

* * * * *

UNITED STATES PATENT AND TRADEMARK OFFICE

CERTIFICATE OF CORRECTION

PATENT NO. : 4,162,915

DATED : July 31, 1979

INVENTOR(S) : Robert H. Maes and Luc M. Fontainas

It is certified that error appears in the above-identified patent and that said Letters Patent are hereby corrected as shown below:

On the first page of the Deed, within the identification "[30] Foreign Application Priority Data", "Sep. 6, 1976 [BE] Belgium . . . 732" should read --Sep. 6, 1976 [LU] Luxembourg . . . 75 732--.

Col. 3, line 36, "phases" should read --phase--.

Col. 5, line 15, "from" should read --after--.

Cols. 9 & 10, about line 5, "Table IIB" should read --Table IIIB--.

Col. 10, line 27, "buillion" should read --bullion--.

Col. 12, line 12, "Example 1" should read --Example 2--.

Tables IA, IB, IIA, IIIB, IVA, and IVB should appear as shown on the attached sheets.

Signed and Sealed this

*Twelfth* Day of *February 1980*

[SEAL]

*Attest:*

*Attesting Officer*

SIDNEY A. DIAMOND

*Commissioner of Patents and Trademarks*

Table IA

Analysis

| | Ag ppm | Pb % | Cu % | Bi % | Ni % | Co % | As % | Sb % | Sn % | Zn % | CaO % | SiO2 % | Fe % | S % |
|---|---|---|---|---|---|---|---|---|---|---|---|---|---|---|
| Fly ashes | 269 | 63.27 | 0.44 | 0.117 | <0.05 | | 4.06 | 0.28 | 0.55 | 4.66 | | | | 7.10 |
| Slag | 27 | 22.27 | 1.54 | 0.002 | 0.19 | 1.09 | 1.14 | 0.54 | 0.56 | 13.23 | 3.05 | 20.27 | 10.82 | 0.18 |
| Matte | 2390 | 24.94 | 54.76 | 0.009 | 0.87 | 0.23 | 0.85 | 0.52 | 0.05 | 0.09 | | | 0.18 | 15.60 |
| Arsenical alloy | 3665 | 25.42 | 36.32 | 0.079 | 10.39 | 0.28 | 12.02 | 7.58 | 0.11 | <0.05 | | | 0.09 | 2.00 |
| Lead bullion | 4400 | 95.82 | 1.12 | 0.34 | 0.12 | | 0.04 | 0.43 | <0.001 | | | | | 0.10 |

Material balance

| | kg | Ag g | Pb kg | Cu kg | Bi g | Ni kg | Co kg | As kg | Sb kg | Sn kg | Zn kg | CaO kg | SiO2 kg | Fe kg | S kg |
|---|---|---|---|---|---|---|---|---|---|---|---|---|---|---|---|
| Fly ashes | 15.5 | 4.2 | 9.81 | 0.07 | 18.1 | <0.01 | | 0.63 | 0.04 | 0.09 | 0.72 | | | | 1.10 |
| Slag | 95.8 | 2.6 | 21.33 | 1.47 | 1.9 | 0.18 | 1.04 | 1.09 | 0.52 | 0.54 | 12.67 | 2.92 | 19.42 | 10.36 | 0.17 |
| Matte | 33.6 | 80.3 | 8.38 | 18.40 | 3.0 | 0.29 | 0.08 | 0.29 | 0.17 | 0.02 | 0.03 | | | 0.06 | 5.24 |
| Arsenical alloy | 6.4 | 23.5 | 1.63 | 2.32 | 5.1 | 0.66 | 0.02 | 0.77 | 0.49 | 0.01 | 0.00 | | | 0.01 | 0.13 |
| Lead bullion | 27.6 | 121.4 | 26.45 | 0.31 | 93.8 | 0.03 | | 0.01 | 0.12 | 0.00 | | | | | 0.03 |
| Total | 178.9 | 232.0 | 67.60 | 22.57 | 121.9 | 1.17 | 1.14 | 2.79 | 1.34 | 0.66 | 13.42 | 2.92 | 19.42 | 10.43 | 6.67 |

Table IB

Analysis

| | Ag ppm | Pb % | Cu % | Bi % | Ni % | Co % | As % | Sb % | Sn % | Zn % | CaO % | SiO2 % | Fe % | S % |
|---|---|---|---|---|---|---|---|---|---|---|---|---|---|---|
| Fly ashes | 5 | 8.02 | 0.20 | 0.002 | <0.05 | <0.05 | 0.26 | 0.07 | 0.27 | 73.27 | | | <0.05 | 0.12 |
| Slag | <1 | 0.76 | 0.15 | <0.001 | <0.05 | 0.32 | <0.05 | <0.05 | 0.20 | 3.06 | 19.78 | 31.39 | 15.09 | 0.25 |
| Arsenical alloy | 22 | 6.07 | 17.54 | 0.001 | 2.81 | 18.60 | 18.42 | 2.36 | 3.28 | <0.05 | | | 30.37 | 0.25 |
| Lead bullion | 103 | 95.13 | 1.27 | 0.006 | 0.08 | | 0.15 | 1.75 | 1.09 | | | | | <0.01 |

Material balance

| | kg | Ag g | Pb kg | Cu kg | Bi g | Ni kg | Co kg | As kg | Sb kg | Sn kg | Zn kg | CaO kg | SiO2 kg | Fe kg | S kg |
|---|---|---|---|---|---|---|---|---|---|---|---|---|---|---|---|
| Fly ashes | 14.3 | 0.1 | 1.15 | 0.03 | 0.3 | <0.01 | <0.01 | 0.04 | 0.01 | 0.04 | 10.48 | | | <0.01 | 0.02 |
| Slag | 59.2 | <0.1 | 0.45 | 0.09 | <0.6 | <0.03 | 0.19 | <0.03 | <0.03 | <0.12 | 1.81 | 11.71 | 18.58 | 8.93 | 0.15 |
| Arsenical alloy | 5.7 | 0.1 | 0.35 | 1.00 | 0.1 | 0.16 | 1.06 | 1.05 | 0.13 | 0.19 | <0.003 | | | 1.73 | 0.01 |
| Lead bullion | 20.7 | 2.1 | 19.69 | 0.26 | 1.2 | 0.02 | | 0.03 | 0.36 | 0.23 | | | | | <0.002 |
| Total | 99.9 | 2.4 | 21.64 | 1.38 | 2.2 | 0.22 | 1.26 | 1.15 | 0.53 | 0.58 | 12.29 | 11.71 | 18.58 | 10.67 | 0.18 |

Table IIA

Analysis

| | Ag ppm | Pb % | Cu % | Bi % | Ni % | Co % | As % | Sb % | Sn % | Zn % | CaO % | SiO2 % | Fe % | S % |
|---|---|---|---|---|---|---|---|---|---|---|---|---|---|---|
| Fly ashes | 51 | 52.12 | 0.61 | 0.13 | - | - | 2.27 | 0.18 | 0.50 | 3.07 | - | - | - | 7.52 |
| Slag | 20 | 25.40 | 1.05 | 0.004 | 0.26 | 1.08 | 1.43 | 0.71 | 1.06 | 7.99 | 8.14 | 16.09 | 17.26 | 0.25 |
| Matte | 646 | 34.73 | 44.27 | 0.006 | 0.76 | 0.10 | 0.50 | 0.26 | 0.05 | 0.10 | - | - | 0.10 | 15.50 |
| Arsenical alloy | 951 | 7.69 | 29.51 | 0.05 | 29.73 | 1.07 | 24.69 | 5.38 | 0.10 | - | - | - | - | 1.80 |
| Lead bullion | 1331 | 97.00 | 1.25 | 0.42 | - | - | 0.11 | 0.54 | - | - | - | - | - | 0.10 |

Material balance

| | kg | Ag g | Pb kg | Cu kg | Bi g | Ni kg | Co kg | As kg | Sb kg | Sn kg | Zn kg | CaO kg | SiO2 kg | Fe kg | S kg |
|---|---|---|---|---|---|---|---|---|---|---|---|---|---|---|---|
| Fly ashes | 114 | 5.8 | 59.4 | 0.7 | 148.2 | - | - | 2.6 | 0.2 | 0.6 | 3.5 | - | - | - | 8.6 |
| Slag | 960 | 19.2 | 243.8 | 10.1 | 38.4 | 2.5 | 10.4 | 13.7 | 6.8 | 10.2 | 76.7 | 78.1 | 154.5 | 165.7 | 2.2 |
| Matte | 311 | 200.9 | 108.0 | 137.6 | 18.7 | 2.4 | 0.3 | 1.6 | 0.8 | 0.2 | 0.3 | - | - | 0.3 | 48.2 |
| Arsenical alloy | 72 | 68.5 | 5.5 | 21.2 | 3.6 | 21.3 | 0.8 | 17.7 | 3.9 | 0.1 | - | - | - | - | 1.3 |
| Lead bullion | 349 | 464.5 | 338.2 | 4.4 | 1465.8 | - | - | 0.4 | 1.9 | - | - | - | - | - | 0.3 |
| Total | 1806 | 758.9 | 754.9 | 174.0 | 1674.7 | 26.2 | 11.5 | 36.0 | 13.6 | 11.1 | 80.5 | 78.1 | 154.5 | 166.0 | 60.6 |

Table IIIB

Analysis

| | Ag ppm | Pb % | Cu % | Bi % | Ni % | Co % | As % | Sb % | Sn % | Zn % | CaO % | SiO2 % | Fe % | S % |
|---|---|---|---|---|---|---|---|---|---|---|---|---|---|---|
| Fly ashes | - | 13.36 | 0.12 | - | - | - | 0.53 | 0.04 | 0.29 | 66.64 | - | - | 0.08 | 0.13 |
| Slag | - | 0.37 | 0.09 | - | 0.02 | 0.01 | 0.07 | 0.04 | 0.40 | 3.06 | 19.25 | 30.94 | 20.26 | 0.40 |
| Arsenical alloy | 18 | 6.42 | 12.57 | 0.002 | 2.36 | 0.47 | 20.60 | 2.73 | 5.35 | 0.38 | - | - | 47.89 | 0.28 |
| Lead bullion | 263 | 92.25 | 1.09 | 0.012 | - | - | 0.10 | 1.82 | 2.67 | - | - | - | - | 0.01 |

Material balance

| | kg | Ag kg | Pb kg | Cu kg | Bi kg | Ni kg | Co kg | As kg | Sb kg | Sn kg | Zn kg | CaO kg | SiO2 kg | Fe kg | S kg |
|---|---|---|---|---|---|---|---|---|---|---|---|---|---|---|---|
| Fly ashes | 365 | - | 48.8 | 0.4 | - | - | - | 2.0 | 0.1 | 1.0 | 243.5 | - | - | 0.3 | 0.5 |
| Slag | 1520 | - | 5.6 | 1.4 | - | 0.4 | 0.2 | 1.1 | 0.7 | 6.1 | 46.6 | 292.7 | 470.4 | 308.0 | 6.0 |
| Arsenical alloy | 311 | - | 20.0 | 39.1 | - | 7.4 | 1.5 | 64.2 | 8.5 | 16.7 | 1.2 | - | - | 149.2 | 0.9 |
| Lead bullion | 1084 | 0.3 | 1000.5 | 11.8 | 0.1 | - | - | 1.1 | 19.7 | 29.0 | - | - | - | - | 0.1 |
| Total | 3280 | 0.3 | 1074.9 | 52.7 | 0.1 | 7.8 | 1.7 | 68.4 | 29.0 | 52.8 | 291.3 | 292.7 | 470.4 | 457.5 | 7.5 |

Table IVA

Analysis

| | Ag ppm | Pb % | Cu % | Bi % | Ni % | As % | Sb % | Sn % | Zn % | CaO % | SiO2 % | Fe % | S % |
|---|---|---|---|---|---|---|---|---|---|---|---|---|---|
| Fly ashes | 209 | 50.86 | 0.48 | 0.51 | - | 0.24 | 0.07 | 0.14 | 2.88 | - | - | - | 7.42 |
| Slag | 79 | 29.33 | 1.55 | 0.014 | 0.02 | 0.11 | 0.35 | 0.18 | 10.51 | 5.77 | 16.72 | 13.89 | 0.27 |
| Matte | 2627 | 20.76 | 58.24 | 0.025 | 0.06 | 0.08 | 0.10 | 0.03 | 0.15 | - | - | 0.18 | 16.25 |
| Lead bullion | 5409 | 96.00 | 1.63 | 1.42 | - | 0.02 | 0.21 | - | - | - | - | - | 0.12 |

Material balance

| | kg | Ag kg | Pb kg | Cu kg | Bi kg | Ni kg | As kg | Sb kg | Sn kg | Zn kg | CaO kg | SiO2 kg | Fe kg | S kg |
|---|---|---|---|---|---|---|---|---|---|---|---|---|---|---|
| Fly ashes | 270 | 0.1 | 137.3 | 1.3 | 1.4 | - | 0.6 | 0.2 | 0.4 | 7.8 | - | - | - | 20.0 |
| Slag | 3330 | 0.3 | 976.7 | 51.6 | 0.5 | 0.7 | 3.7 | 11.7 | 6.0 | 350.0 | 192.1 | 556.8 | 462.5 | 9.0 |
| Matte | 959 | 2.5 | 199.1 | 558.6 | 0.2 | 0.6 | 0.8 | 1.0 | 0.3 | 1.4 | - | - | 1.7 | 155.8 |
| Lead bullion | 168 | 0.9 | 161.3 | 2.7 | 2.4 | - | - | 0.4 | - | - | - | - | - | 0.2 |
| Total | 4727 | 3.8 | 1474.4 | 614.2 | 4.5 | 1.3 | 5.1 | 13.3 | 6.7 | 359.2 | 192.1 | 556.8 | 464.2 | 185.0 |

Table IVB

Analysis

| | Ag ppm | Pb % | Cu % | Bi % | Ni % | As % | Sb % | Sn % | Zn % | CaO % | SiO2 % | Fe % | S % |
|---|---|---|---|---|---|---|---|---|---|---|---|---|---|
| Fly ashes | - | 13.29 | 0.50 | - | - | 0.47 | 0.03 | 0.05 | 64.78 | - | - | 0.13 | 0.15 |
| Slag | - | 0.82 | 0.71 | - | 0.05 | 0.05 | 0.03 | 0.09 | 4.42 | 17.44 | 26.68 | 23.03 | 0.37 |
| Lead bullion | 271 | 93.20 | 3.40 | 0.037 | - | 0.15 | 1.06 | 0.47 | - | - | - | - | 0.01 |

Material balance

| | kg | Ag kg | Pb kg | Cu kg | Bi kg | Ni kg | As kg | Sb kg | Sn kg | Zn kg | CaO kg | SiO2 kg | Fe kg | S kg |
|---|---|---|---|---|---|---|---|---|---|---|---|---|---|---|
| Fly ashes | 385 | - | 51.2 | 1.9 | - | - | 1.8 | 0.1 | 0.2 | 249.2 | - | - | 0.5 | 0.6 |
| Slag | 1945 | - | 15.9 | 13.8 | - | 1.0 | 1.0 | 0.6 | 1.7 | 86.0 | 339.1 | 518.8 | 447.9 | 7.2 |
| Lead bullion | 910 | 0.2 | 848.1 | 31.0 | 0.3 | - | 1.4 | 9.7 | 4.3 | - | - | - | - | 0.1 |
| Total | 3240 | 0.2 | 915.2 | 46.7 | 0.3 | 1.0 | 4.2 | 10.4 | 6.2 | 335.4 | 339.1 | 518.8 | 448.4 | 7.9 |